US005982081A

United States Patent [19]

Sin et al.

[11] Patent Number: 5,982,081

[45] Date of Patent: Nov. 9, 1999

[54] FIELD EMISSION DISPLAY HAVING ELONGATE EMITTER STRUCTURES

[75] Inventors: Johnny Kin On Sin, Shatin; Bao Ping Wang, Clear Water Bay, both of The Hong Kong Special Administrative Region of the People's Republic of China

[73] Assignee: The Hong Kong University of Science & Technology, The Hong Kong Special Administrative Region of the People's Republic of China

[21] Appl. No.: 08/759,678

[22] Filed: Dec. 6, 1996

[51] Int. Cl.[6] ..... H01J 1/46; H01J 21/10; H01J 19/14

[52] U.S. Cl. ..... 313/309; 313/336

[58] Field of Search ..... 313/309, 310, 313/336, 351, 495, 496, 497; 445/49, 50, 24

[56] References Cited

U.S. PATENT DOCUMENTS 5,382,185 1/1995 Gray et al. ..... 313/309

*Primary Examiner*—William Oen

*Attorney, Agent, or Firm*—Burns, Doane, Swecker & Mathis, L.L.P.

[57] ABSTRACT

Field emitter structures are described for use in arrays forming field emission displays. The field emitter structures may be either single or perferably double-gate structures. To enhance the field emission current density the emitters are formed so as to be elongate so as to form a race-track shape. The emitter layer may also be provided with sharply defined edges in order to improve electron emission.

13 Claims, 10 Drawing Sheets

FIELD EMISSION DISPLAY HAVING ELONGATE EMITTER STRUCTURES

FIELD OF THE INVENTION

This invention relates to field emission displays, and in particular to such displays that are cheaper to manufacture than conventional designs. In particular the invention provides novel field emitter structures that may be employed in arrays forming such displays. The invention also relates to apparatus and devices incorporating such displays.

BACKGROUND TO THE INVENTION

Field emission displays (FEDs) have been known for a number of years as an alternative to active matrix liquid crystal displays (AMLCDs). Indeed FEDs are known to have a number of advantages. They can be made thinner and lighter while having better operating characteristics compared to an AMLCD. In particular an FED may have a higher contrast ratio, wider viewing angle and greater brightness. They can operate on lower power and over a wider range of operating temperatures.

The major drawback preventing wider use of FEDs, however, is their cost. They are expensive to manufacture, for reasons which become apparent when you examine more closely their structure.

FIG. 1 shows in cross-section a conventional field emitter arrangement, a number of which may be arranged in an array to form a display. The emitters 1 comprise cones of metal deposited onto a cathode 2. The emitters 1 are located between gate electrodes 3 that themselves are mounted on the cathode 2 through insulating material 4. When a voltage is applied between the gate and emitter electrodes electrons are emitted from the tips of the emitters 1 and these electrons strike a phosphor coated faceplate where they create illumination through the conventional process of electroluminescence.

A single visible pixel in a display may contain as many as 1600 such field emitters and therefore it will be appreciated that the dimensions involved are small. The spacing between the tip of a field emitter and the gate electrodes, for example, is of the order of 0.5 micron, and it is critical in determining parameters such as turn-on voltage and current density. In addition, to provide strong electron emission, the field emitter tip should be as sharp as possible. These requirements place stringent conditions on the manufacturing process and while effective field emission displays using the design of FIG. 1 can be manufactured, they are very expensive and their use is limited as a consequence.

There is therefore a need to provide a field emission display design that would be simpler (and therefore cheaper) to manufacture. One possible design has been proposed in H. Busta et al., "Volcano-Shaped Field Emitters for Large Area Displays", *Proc. IEDM*, pp 405–408, 1995. FIG. 2 illustrates schematically the type of field emitter proposed in this paper. Effectively the traditional design is inverted and instead of an emitter being placed between two gate electrodes, an emitter is placed on either side of a post gate.

In FIG. 2 a single gate post 5 is formed on a layer of n-silicon. This gate 5 is raised from the surface of the n-silicon substrate and is generally circular or regular polygonal in cross-section (hence the description "volcano shaped"). On this substrate there is deposited firstly an insulating layer of silicon dioxide 6 and then an emitter layer 7. This manufacturing process is considerably simpler and the dimensions less critical than in the conventional FED manufacturing process. Unfortunately, however, the resulting FED does not have high performance characteristics for a number of reasons.

Firstly, as can be seen from FIG. 2, the ends 7' of the emitter layer adjacent to the gate post—and from which electrons will be emitted—do not form a point which fact results in reduced electron emission. Secondly, one of the advantages of a conventional design as shown in FIG. 1 is that the field emitter is located symmetrically between two gate electrodes. This means that when an electron is emitted there is no tendency for it to be drawn to one gate electrode or the other and it passes between them towards the phosphor face plate. However, in the design proposed by Busta et al this symmetry is lost and a significant number of electrons emitted by the emitter are drawn to the gate post to form a leakage gate current.

The design proposed by Busta et al provides good uniformity over large areas without the need for expensive sub-micron manufacturing techniques. However the turn-on voltage is increased substantially. Furthermore due to the circular nature of the shape of the emitter a low cell density results. This in turn causes the field emission current density to be small. In addition this structure gives a large beam spot which is not always desirable. These and other disadvantages mean that the performance of a field emitter according to the proposal of Busta et al is disappointing.

SUMMARY OF THE INVENTION

It is an object of the present invention to provide a field emitter display in which these disadvantages are overcome or at least mitigated.

According to the present invention there is provided a field emitter structure for a display device comprising, a first gate electrode formed on a substrate so as to extend therefrom, a first insulating layer formed on said substrate and surrounding said first gate electrode, an emitter layer formed on said first insulating layer and spaced from said gate electrode by said insulating layer, a second insulating layer formed on said emitter layer, and a second gate electrode formed on said second insulating layer.

By means of this arrangement the emitter layer is sandwiched between two gate electrodes, the first post gate electrode and a second in the form of a layer deposited on an insulating layer in turn deposited on the emitter layer. Thus at the end of the emitter layer where electrons are emitted there is a gate electrode on either side and this symmetry reduces the leakage gate current and allows the turn-on voltage to be reduced.

Preferably the substrate is Si and the post gate electrode, ie the first gate electrode, is formed as a post on the substrate. The first and second insulating layers may both be a layer of $SiO_2$ deposited by conventional vacuum deposition techniques onto the substrate/first gate electrode and the emitter layer respectively.

The emitter layer may be a metal (eg Ti—W/Au) or may be silicon. Although not essential, the structure is easier to fabricate if the emitter layer is formed of silicon since in that way it is easier for the inter-dielectric between the emitter and the second gate to de deposited.

The first gate electrode may be in the form of an upstanding cone of circular or regular polygonal cross-section. Preferably, however, the first gate electrode is elongate in one direction having two substantially parallel sides and the first insulating layer, emitter layer, second insulating layer and second gate electrode extend along the full length of the parallel sides of the gate electrode.

Indeed this shape for the first gate electrode is advantageous independently of the provision of a second gate electrode.

Accordingly therefore the present invention also extends to a field emitter structure for a display device comprising a gate electrode formed on a substrate so as to extend therefrom, an insulating layer formed on said substrate and surrounding said gate electrode, and an emitter layer formed on said insulating layer such that said emitter layer is spaced from said gate electrode by said insulating layer, wherein said gate electrode is generally elongate and is formed with two substantially parallel sides, and wherein said insulating layer and said emitter layer extend for the length of said sides.

The performance of embodiments of the present invention will be enhanced if the exposed edge of the emitter layer (from which in use electrons will be emitted) can be made so as to come to a point. This can be achieved by selective removal of parts of the edge of the emitter layer, for example by forming the emitter layer of polysilicon and selectively oxidising and removing the corners of the edge of the layer so that the edge forms a point. Furthermore, deficiency of the polysilicon emitter for electron emission can be greatly improved by metal coating of the polysilicon emitter to form a metal polycide.

According to the present invention therefore there is further provided a field emitter structure for a display device comprising a gate electrode formed on a substrate so as to extend therefrom, an insulating layer formed on said substrate and surrounding said gate electrode, and an emitter layer formed on said insulating layer such that said emitter layer is spaced from said gate electrode by said insulating layer, said emitter layer being formed with an exposed edge for the emission of electrons in use and said edge being formed so as to be sharply defined.

It will of course also be understood that the invention also extends to field emission displays incorporating an array of such structures, and to apparatus including such field emission displays.

BRIEF DESCRIPTION OF THE DRAWINGS

Some embodiments of the present invention will now be described by way of example and with reference to the accompanying drawings, in which.

DETAILED DESCRIPTION OF PREFERRED EMBODIMENTS

Figure 1:
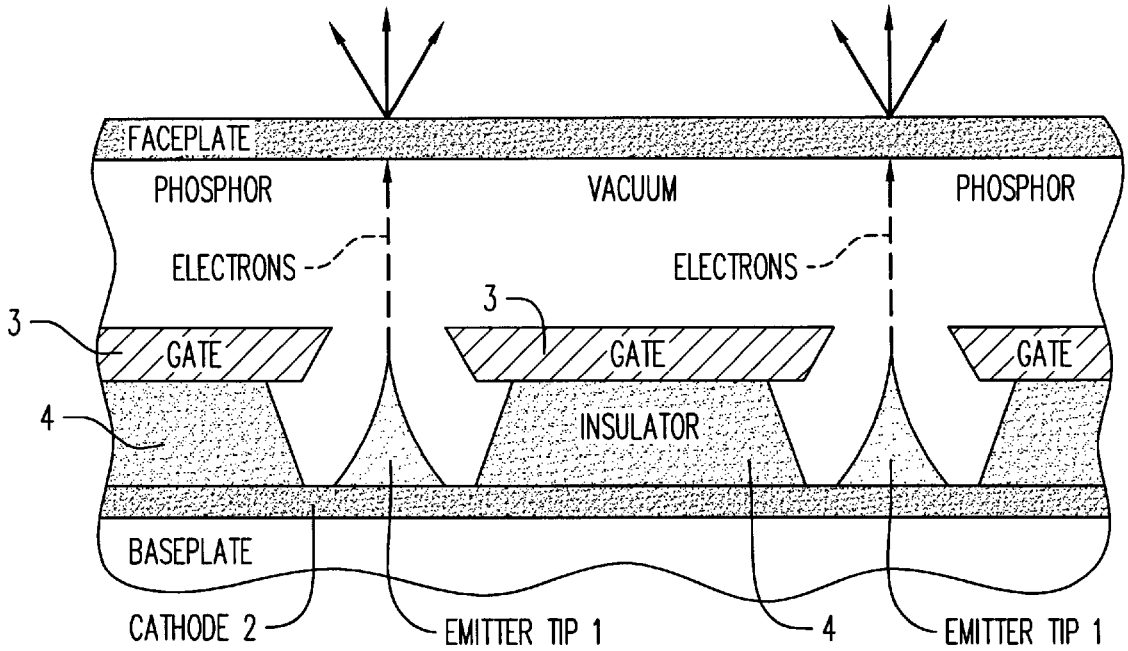
FIG. 1 is a cross-section through a conventional cone-type field emission display.
Figure 2:
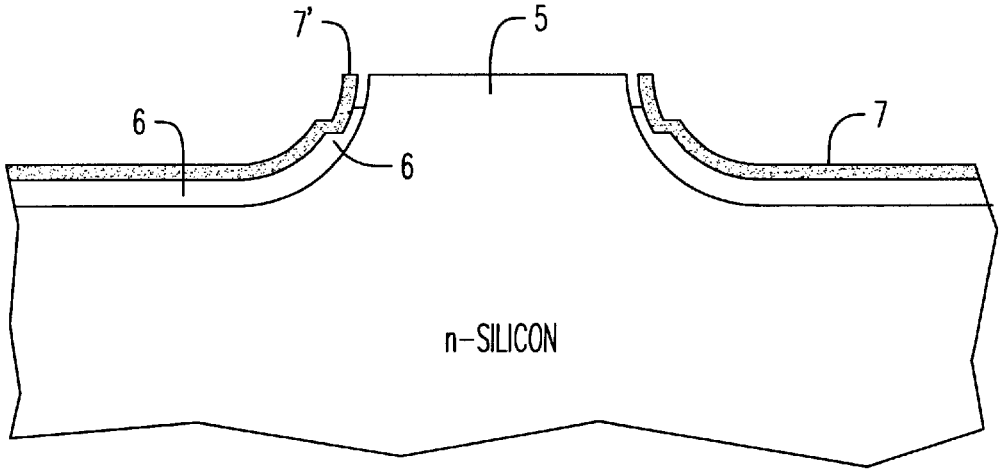
FIG. 2 is a cross-section of a field emitter design according to the prior art.
Figure 3:
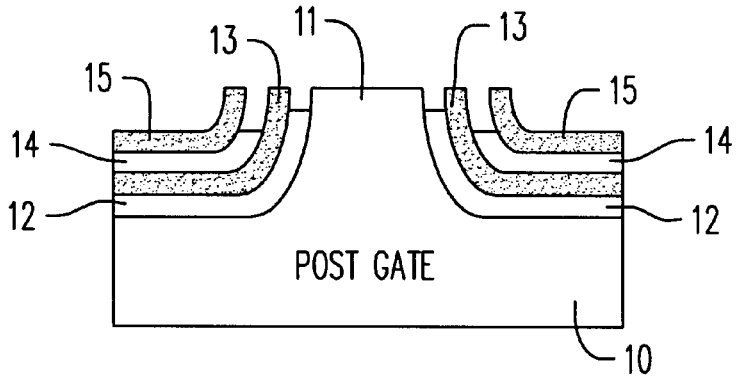
FIG. 3 is a cross-section of a field emitter according to an embodiment of the present invention.

Referring firstly to FIG. 3 there is shown a double-gate field emitter structure in accordance with an embodiment of the invention. The structure of FIG. 3 comprises a n-silicon substrate 10 which is formed with an integral upstanding gate post forming a first gate electrode 11 of the same material. An insulating $SiO_2$ layer 12 is then deposited on the surface of the substrate 10 and the circumferential surface of the gate electrode 11 and an emitter layer 13 is in turn deposited on the insulating layer 12. The emitter layer is preferably metal and may, for example, comprise an alloy of Ti—W/Au. Such a structure may be readily formed by conventional vacuum deposition techniques.

As described so far the structure is similar to that described by Busta et al, however in this embodiment of the present invention a further insulating $SiO_2$ layer 14 is provided on top of the emitter layer 13 and a further layer 15 is formed on top of the second insulating layer 14. Layer 15 may be formed of the same material as the emitter layer 13, ie Ti—W/Au, and functions as a second gate electrode and is connected with the first gate electrode 11.

By providing the second gate electrode 15 it will be seen that the end 13' of the emitter layer 13, ie the end from which electrons will be emitted in use, is located between two gate electrodes. Thus when an electron is emitted from the emitter layer 13 there is a reduced gate leakage current owing to the symmetrical distribution of the two gate electrodes about the emitter layer 13. This also reduces the turn-on voltage of the emitter due to the re-distribution of the electric field at the emitter.

Figure 5:
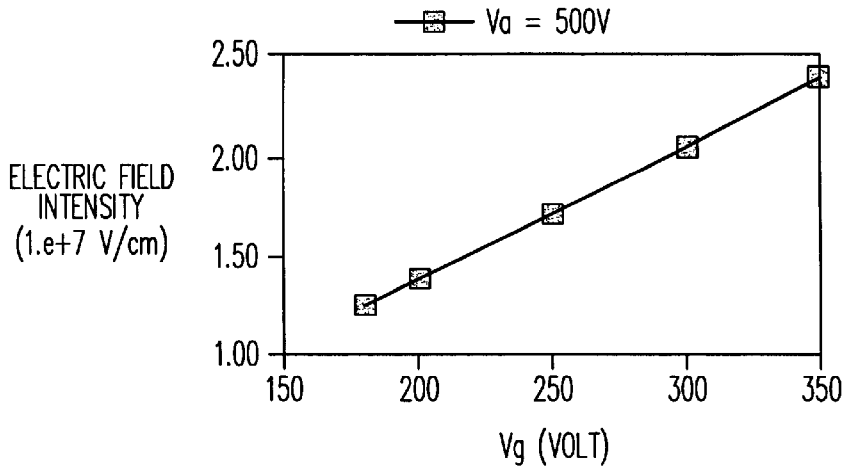
FIG. 5 is a plot of the electric field at the emitter as a function of the gate voltage in the embodiment of FIG. 3.
Figure 6:
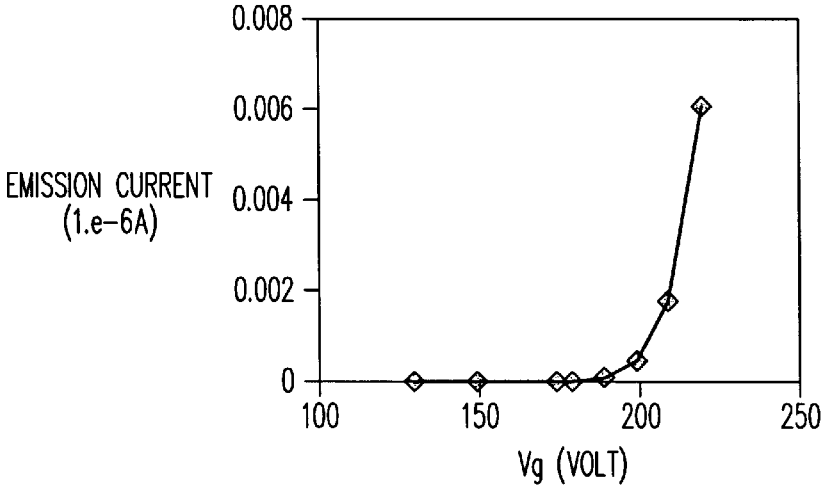
FIG. 6 is a plot of the emission current against gate voltage for the embodiment of FIG. 3.
Figure 7:
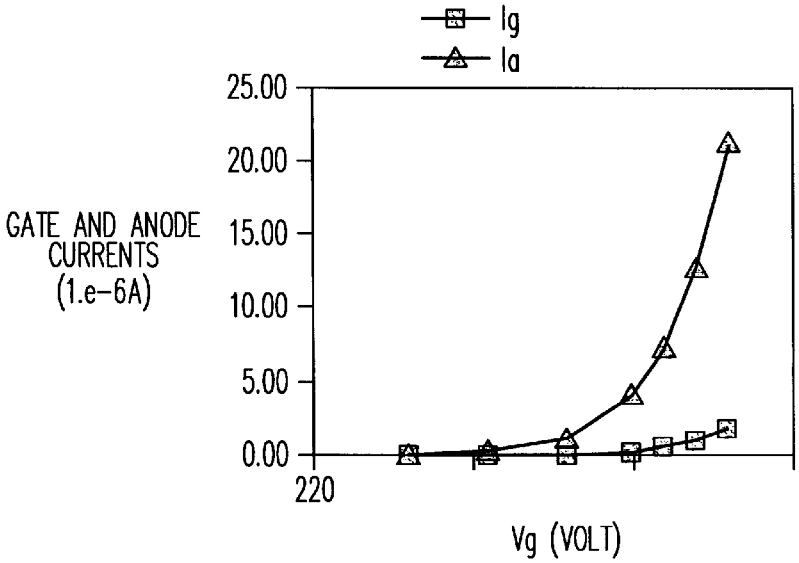
FIG. 7 is a plot of gate and anode currents against gate voltage for the embodiment of FIG. 3.

The properties of this embodiment may be calculated using conventional simulation techniques, in particular by using a finite-difference method in non-orthogonal curvilinear co-ordinate system and a four-order Runge-Kutta method. Using such simulation techniques FIG. 5 shows the electric field at the emitter as a function of the gate voltage with a constant anode voltage of 500V. It can be seen that the electric field is more than $1\times10^7$ V/cm for field emission at a gate voltage of 175 V. Comparing this with the turn-on voltage of a single gate structure (250 V) a 30% reduction in turn-on voltage is obtained. The simulated I-V characteristics of the embodiment of FIG. 3 are shown in FIG. 6 and the gate and anode current characteristics of the device are shown in FIG. 7. These results show that the ratio of anode current to gate current at a gate voltage of 350V is increased by 36 times compared to a single gate structure owing to the reduction in gate leakage current caused by the provision of symmetrical first and second gate electrodes about the emitter.

Figure 4:
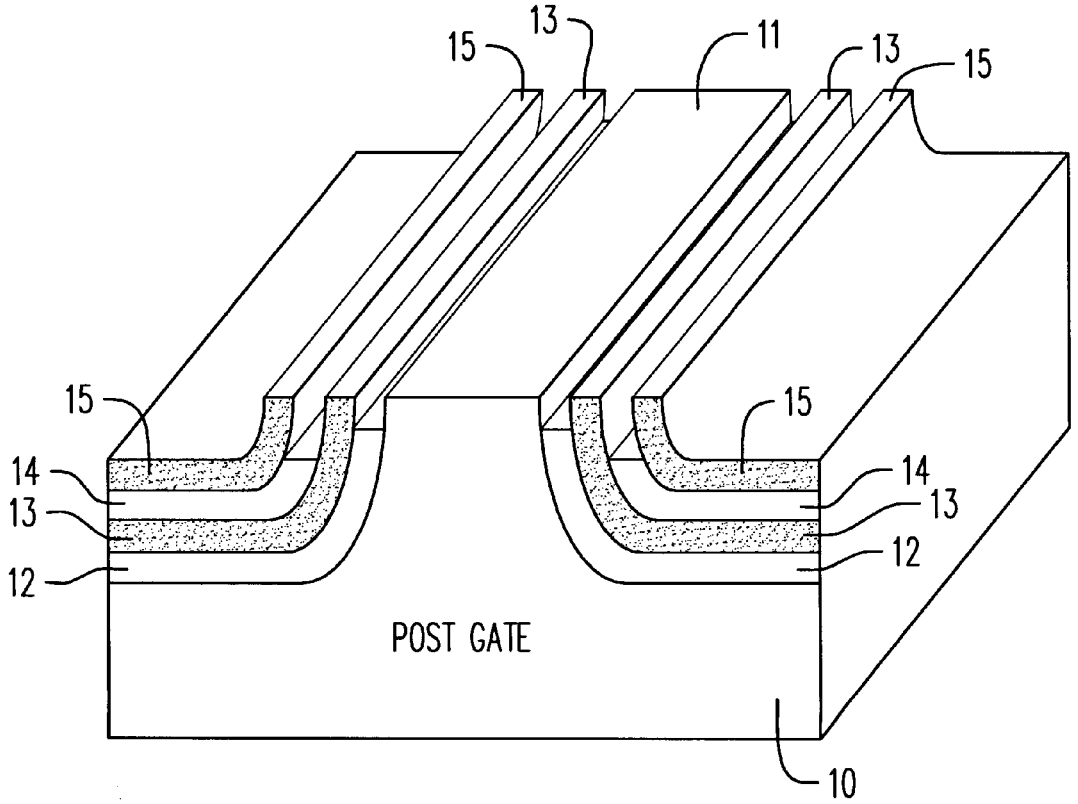
FIG. 4 is a perspective view of the embodiment of FIG. 3.

A further advantage over the prior art is made by making the structure non-circular in plan, but instead making the structure elongate. This is illustrated in FIG. 4 which shows the structure of FIG. 3 in perspective view. As can be seen the gate post forming the first gate electrode 11 is extended in one direction and consequently so also are the first insulating layer 12, emitter layer 13, second insulating layer 14, and the second gate electrode 15. Of course since the gate electrode 11 is of a finite length, these layers and the second gate electrode also go around the ends of the first gate electrode forming a "race-track shaped" structure. In contrast with the "volcano-shaped" structure described in Busta et al, this novel shape for the emitter structure provides good uniformity and large field emission current density. Also it provides line emission capability.

Figure 8:
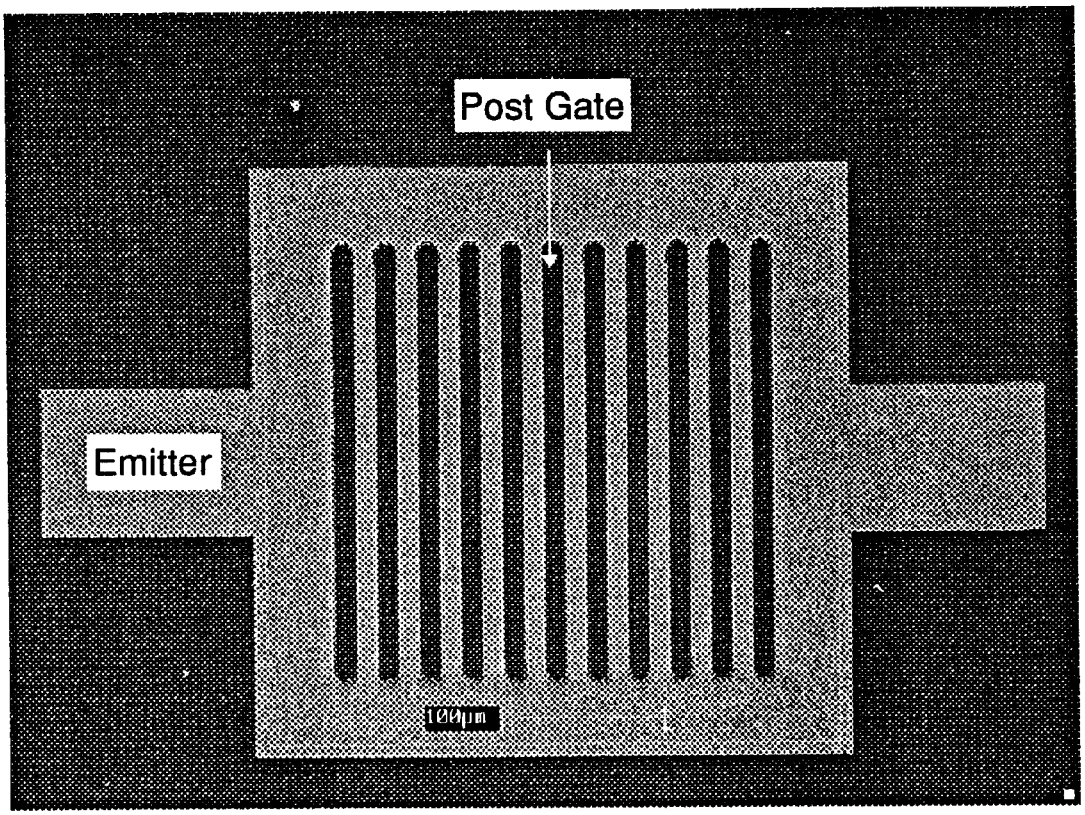
FIG. 8 is a SEM micrograph of a field emitter array according to an embodiment of the invention.

Indeed the advantage of the race-track shaped structure can be seen in single-gate as well as double-gate emitter structures. FIG. 8 is a scanning electron microscope micrograph of a single-gate race-track-shaped field emitter array having an active area of $5.76\times10^{-4}$ $cm^2$. As can be seen from FIG. 8 the device comprises eleven parallel post gate electrodes 21 surrounded by a single integral emitter layer 22. An insulating layer 23 is provided between each gate electrode 21 and the emitter layer 22, and this is shown more clearly in FIG. 9 which is a detail of FIG. 8 at one end of a gate electrode 22.

Figure 9:
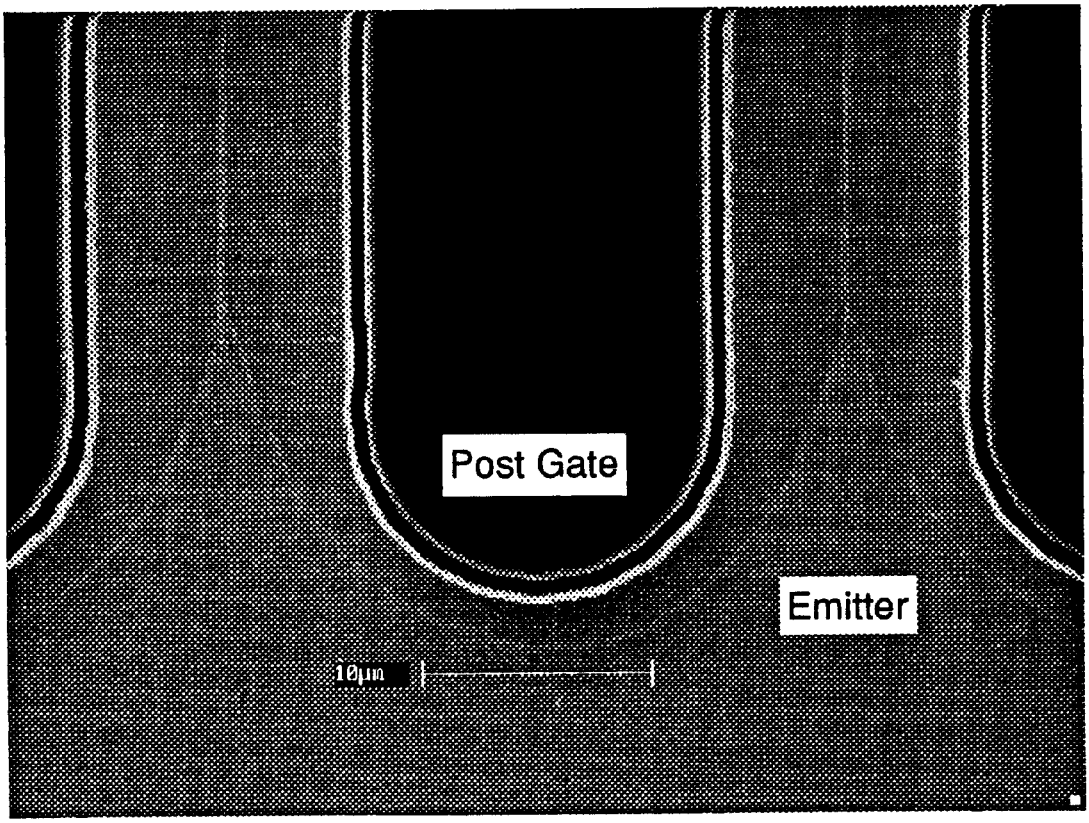
FIG. 9 is a detail of a part of FIG. 8.
Figure 10:
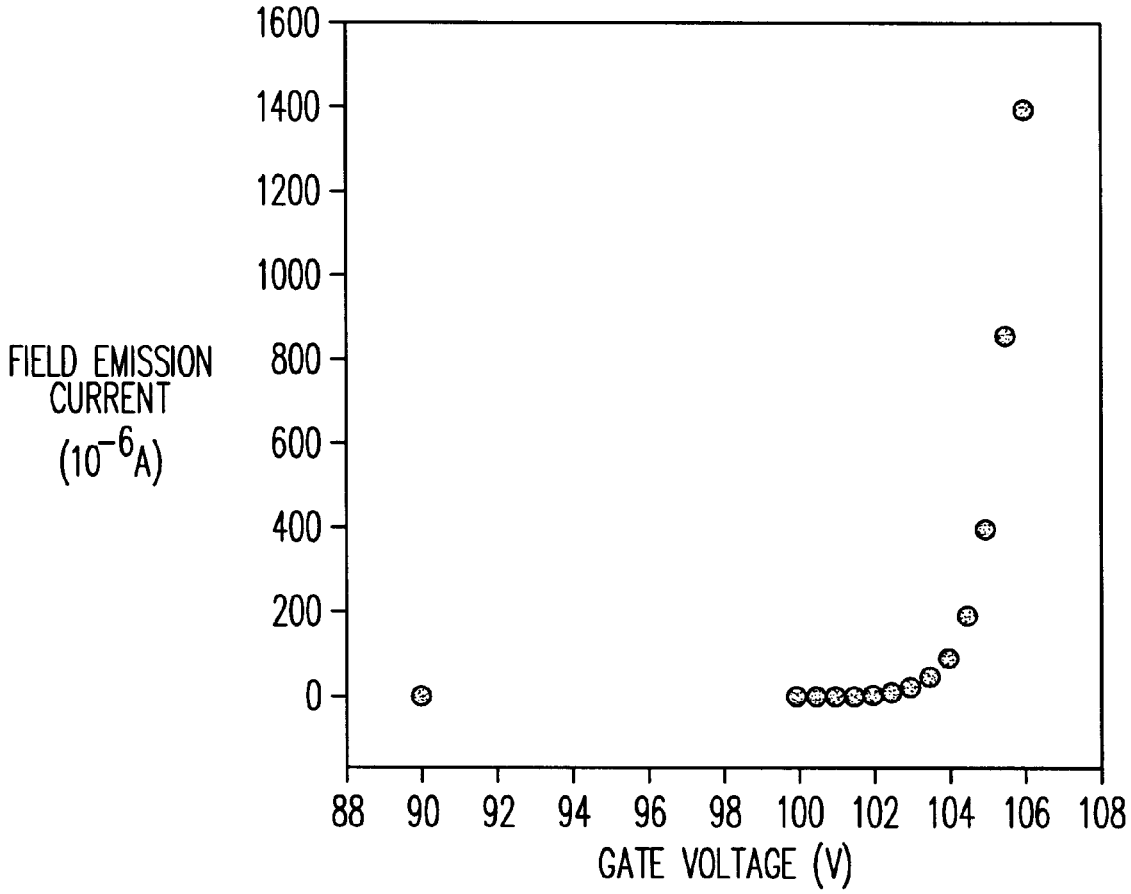
FIG. 10 is a plot showing the field emission current as a function of gate voltage for the array of FIG. 8, FIGS. 11(*a*)–(*c*) illustrate a method for the manufacture of an array as shown in FIG. 8.

The structure of FIGS. 8 & 9 was tested experimentally by packaging the structure inside a vacuum tube evacuated to a pressure of $10^{-6}$ torr and the I-V curve of the device is shown in FIG. 10. The turn-on voltage is approximately 100 V and when the gate voltage is increased to 105V and above the field emission current increases substantially. At a gate voltage of 106V the field emission current is approximately 2.4A/$cm^2$ which is substantially larger than a known volcano-shaped device.

Figure 11A:
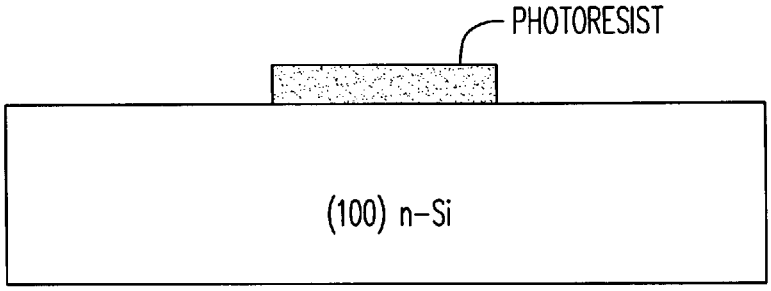
Figure 11B:
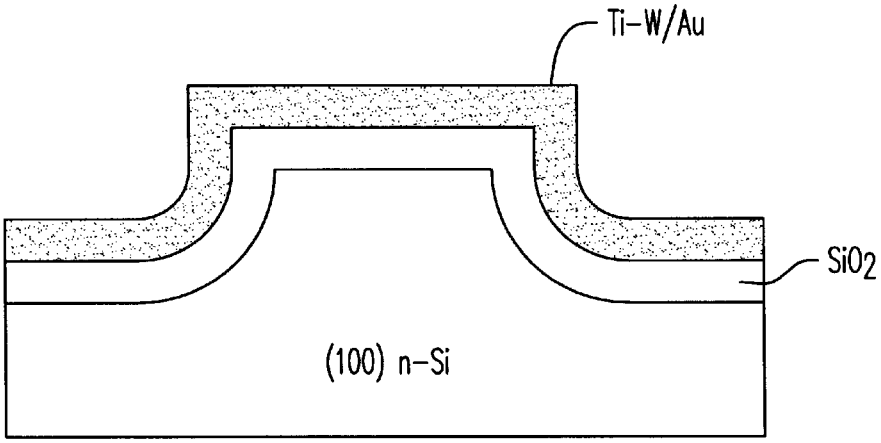
Figure 11C:
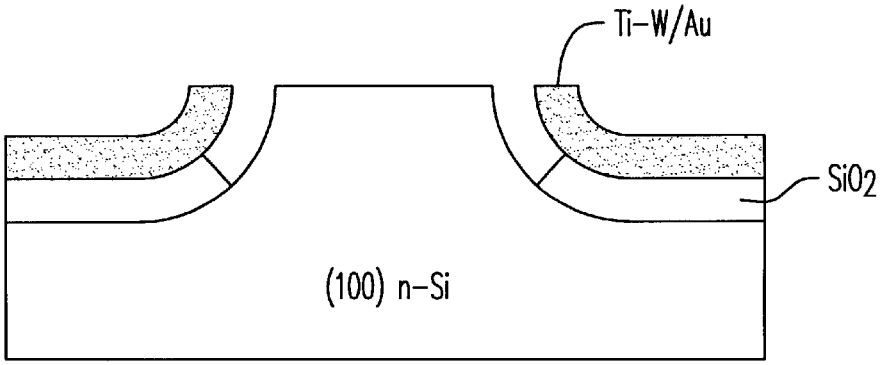

FIGS. 11(*a*)–(*c*) illustrate the fabrication process of the single-gate structure in FIGS. 8 & 9. Firstly silicon posts are formed on an (100) n-type silicon wafer with $\rho$=0.005Ωcm. Then a 1 $\mu$m thick $SiO_2$ layer is deposited using LPCVD. The emitter layer (Ti-W(0. 1 $\mu$m)/Au(0.2 $\mu$m)) is then deposited and following photolithography the emitter rims are formed by metal etching. Finally the $SiO_2$ is removed from the top of the gate electrode. In addition, in order to prevent field emission from the periphery of the emitter lines, an additional mask is used to define a $SiO_2$ layer to isolate the silicon substrate from the emitter metal.

In the embodiments described above the part of the emitter layer from which electrons will be emitted is still rectangular in cross-section. The performance of both the single-gate and double-gate structures can be enhanced (both for volcano- and race-track-shaped devices) if the edge of the emitter layer can be formed so as to come to a point. This can be achieved in a number of ways in the fabrication process.

Figure 12A:
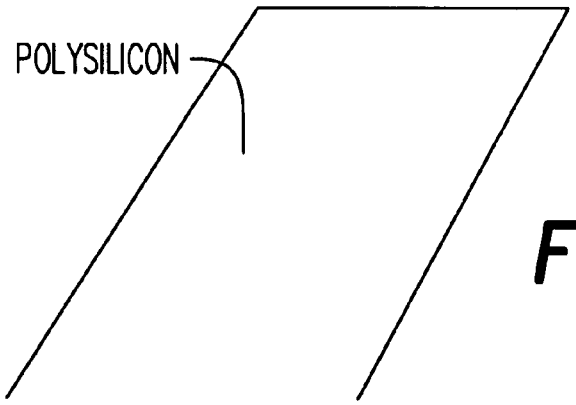
FIG. 12 illustrates a modification to the fabrication process.
Figure 12B:
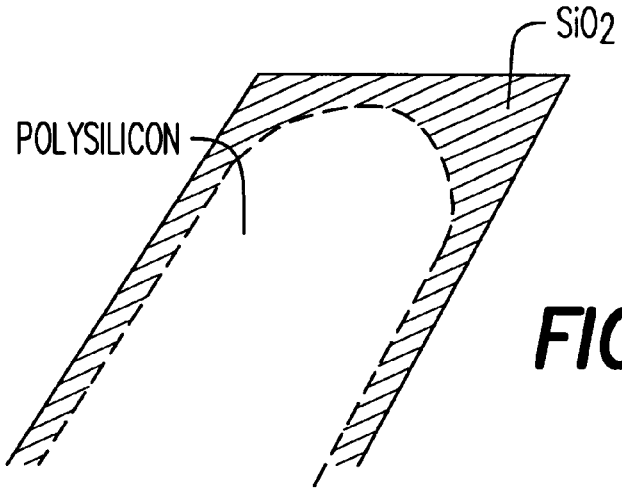
Figure 12C:
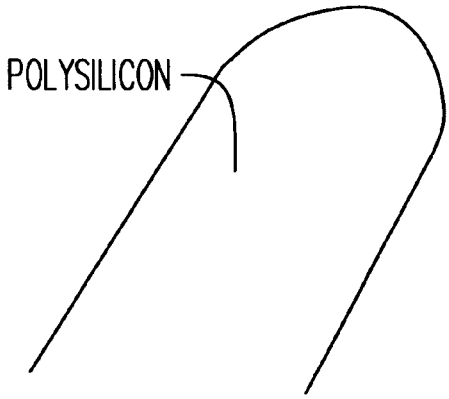

Firstly the emitter layer can be made of polysilicon followed by subsequent oxidation. It is known that polysilicon oxidises at differential rates and oxidation of the polysilicon will result in the $SiO_2$ pattern shown in FIG. 12 by the shaded area. This $SiO_2$ can then be removed to leave a more pointed edge to the emitter layer.

Figure 13A:
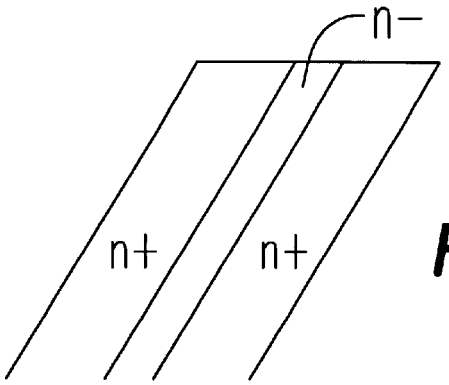
FIG. 13 is a view similar to FIG. 12 showing a further modification.
Figure 13B:
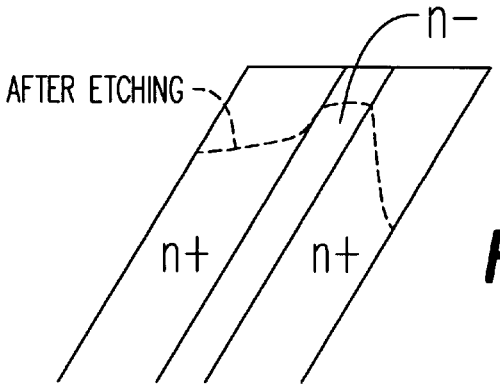
Figure 13C:
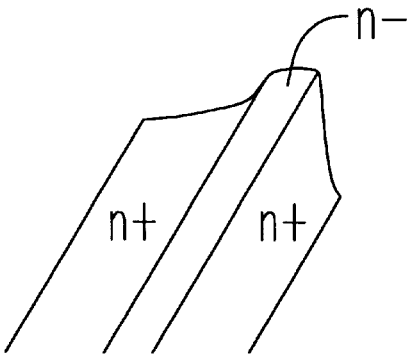

Alternatively the emitter layer can be formed of three sub-layers, in particular two sub-layers of n+-type Si sandwiching a sub-layer of n−-type Si material as shown in FIG. 13. It is known that n+-type material oxidises faster than n−-type material and so a similar oxidation pattern as in FIG. 12 is again obtained and upon removal of the oxidised areas a more pointed edge to the emitter layer is obtained.

To alleviate the electron emission deficiency of a polysilicon emitter, metal coating of the polysilicon emitter to form metal polycide can be used. Metal which does not form silicide with the underlying material will be selectively removed. The polysilicon emitter coated with silicide will greatly enhance the electron emission efficiency of the emitter.

Figure 14:
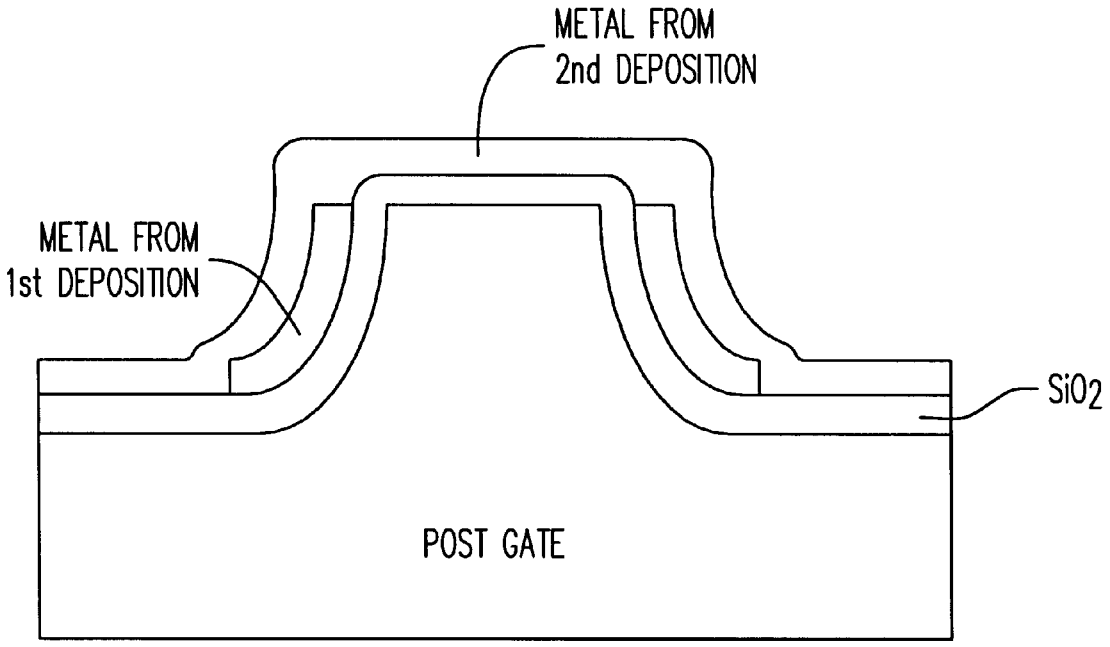
FIG. 14 illustrates a self-alignment process

To reduce the thickness of the inter-dielectric between the gate and the emitter to provide a lower turn-on voltage, a gate to emitter self-alignment process may be employed. A cross-sectional view of a self-aligned structure is shown in FIG. 14. After the deposit of the emitter conducting layer, an anisotropic etching is performed which leaves a layer of the emitter conducting material at the side wall of the gate post electrode only. Then another layer of the same emitter conducting material is deposited. This results in a layer of emitter conducting material with double thickness at the vertical side wall. During emitter material and insulating layer removal alignment can therefore be made within the emitter material with double alignment tolerance, resulting in self-alignment between the emitter adge and the insulating layer edge. This makes an ultra-thin insulating layer possible, thus in turn providing a low turn-on voltage. This self-alignment process may also be used in conjunction with the second gate in a corresponding manner.

We claim:

1. A field emitter structure for a display device comprising, a first gate electrode formed on a substrate so as to extend therefrom, a first insulating layer formed on said substrate and surrounding said first gate electrode, an emitter layer formed on said first insulating layer and spaced from said first gate electrode by said insulating layer, a second insulating layer formed on said emitter layer and a second electrode formed on said second insulating layer, wherein the first gate electrode is elongate in one direction along the surface of the substrate and has two substantially parallel elongate sides, and wherein the first insulating layer, emitter layer, second insulating layer and second gate electrode extend along the full length of the parallel sides of the first gate electrode.

2. A field emitter structure as claimed in claim 1 wherein the first gate electrode is formed as a post integral with and upstanding from said substrate.

3. A field emitter structure as claimed in claim 1 wherein said substrate and said first gate electrode are formed of silicon.

4. A field emitter structure as claimed in claim 1 wherein said emitter layer and said second gate electrode are formed of the same material.

5. A field emitter structure as claimed in claim 1 wherein said emitter layer is formed of metal.

6. A field emitter structure as claimed in claim 1 wherein said emitter layer is formed of polysilicon.

7. A field emitter structure as claimed in claim 1 wherein said emitter layer is formed with a sharply defined exposed edge.

8. A field emitter structure as claimed in claim 1 wherein said emitter layer is formed of increased thickness in the region surrounding said first gate electrode.

9. A field emitter structure for a display device comprising a gate electrode formed on a substrate so as to extend therefrom, an insulating layer formed on said substrate and surrounding said gate electrode, and an emitter layer formed on said insulating layer such that said emitter layer is spaced from said gate electrode by said insulating layer, wherein said gate electrode is generally elongate in one direction along the surface of the substrate and is formed with two substantially parallel elongate sides, and wherein said insulating layer and said emitter layer extend for the length of said sides.

10. A field emitter structure for a display device comprising a gate electrode formed on a substrate so as to extend therefrom, an insulating layer formed on said substrate and surrounding said gate electrode, and an emitter layer formed on said insulating layer such that said emitter layer is spaced from said gate electrode by said insulating layer, said emitter layer being formed with an exposed edge for the emission of electrons in use and said edge being formed so as to be sharply defined.

11. A field emitter structure for a display device comprising, a first gate electrode formed on a substrate so as to extend therefrom, a first insulating layer formed on said substrate and surrounding said first gate electrode, an emitter layer formed on said first insulating layer and spaced from said first gate electrode by said insulating layer, a second insulating layer formed on said emitter layer and a second gate electrode formed on said second insulating layer, wherein said emitter is formed with a sharply defined exposed edge.

12. A field emitter structure for a display device comprising, a first gate electrode formed on a substrate so as to extend therefrom, a first insulating layer formed on said substrate and surrounding said first gate electrode, an emitter layer formed on said first insulating layer and spaced from said first gate electrode by said insulating layer, a second insulating layer formed on said emitter layer and a second electrode formed on said second insulating layer, wherein the first gate electrode is elongate in one direction along the surface of the substrate and has two substantially parallel elongate sides, and wherein the first insulating layer, emitter layer, second insulating layer and second gate electrode extend along the full length of the parallel sides of the first gate electrode, and wherein the emitter layer is formed with a sharply defined exposed edge.

13. A field emitter structure for a display device comprising a gate electrode formed on a substrate so as to extend therefrom, an insulating layer formed on said substrate and surrounding said gate electrode, and an emitter layer formed on said insulating layer such that said emitter layer is spaced from said gate electrode by said insulating layer, wherein said gate electrode is generally elongate in one direction along the surface of the substrate and is formed with two substantially parallel elongate sides, said insulating layer and said emitter layer extending for the length of said sides, and said emitter layer being formed with a sharply defined exposed edge.

* * * * *